US012480312B2

(12) United States Patent
Kerschbaum et al.

(10) Patent No.: US 12,480,312 B2
(45) Date of Patent: Nov. 25, 2025

(54) JOINT STRIP FOR REINFORCEMENT OF DRYWALL PANEL JOINTS

(71) Applicant: KNAUF GIPS KG, Iphofen (DE)

(72) Inventors: Alexander Kerschbaum, Steinsfeld (DE); Thomas Wieczorek, Mainbernheim (DE)

(73) Assignee: KNAUF GIPS KG, Iphofen (DE)

( * ) Notice: Subject to any disclaimer, the term of this patent is extended or adjusted under 35 U.S.C. 154(b) by 156 days.

(21) Appl. No.: 18/252,121

(22) PCT Filed: Nov. 16, 2020

(86) PCT No.: PCT/EP2020/000194
§ 371 (c)(1),
(2) Date: May 8, 2023

(87) PCT Pub. No.: WO2022/100809
PCT Pub. Date: May 19, 2022

(65) Prior Publication Data
US 2023/0407641 A1 Dec. 21, 2023

(51) Int. Cl.

| | |
|---|---|
| ***E04F 13/04*** | (2006.01) |
| ***E04F 13/06*** | (2006.01) |
| ***E04F 21/16*** | (2006.01) |
| ***E04F 21/165*** | (2006.01) |

(52) U.S. Cl.
CPC ..... *E04F 13/042* (2013.01); *E04F 13/068* (2013.01); *E04F 21/1655* (2013.01); *E04F 2013/063* (2013.01)

(58) Field of Classification Search
CPC ..... E04F 13/042; E04F 13/047; E04F 13/06; E04F 13/068; E04F 2013/061; E04F 2013/063; E04F 2013/066; E04F 21/165; E04F 21/1652; E04F 21/1655; E04F 21/1657
See application file for complete search history.

(56) References Cited

U.S. PATENT DOCUMENTS 3,350,825 A * 11/1967 Rillo ..... E04F 13/042 52/287.1
3,455,077 A * 7/1969 Long ..... E04B 1/6809 52/459
4,490,953 A * 1/1985 Meola ..... E04F 13/06 52/211
5,037,686 A * 8/1991 Conboy ..... E04F 13/04 428/156

(Continued)

FOREIGN PATENT DOCUMENTS

DE 3602268 A1 * 7/1987 ..... E04F 13/06
DE 4128810 A1 * 1/1993 ..... E04F 13/04

(Continued)

OTHER PUBLICATIONS

Machine Translation of DE4128810 (Year: 2024).*

(Continued)

*Primary Examiner* — Ryan D Kwiecinski
(74) *Attorney, Agent, or Firm* — Greer, Burns & Crain, Ltd

(57) ABSTRACT

A joint strip for reinforcement of drywall panel joints as well as for a method for reinforcing panel joints i.e. around a corner of a window or door opening is disclosed.

15 Claims, 3 Drawing Sheets

(56) References Cited

U.S. PATENT DOCUMENTS 5,138,810 A * 8/1992 Kartler ..... E04F 13/06 52/255
5,572,834 A * 11/1996 Lilly ..... E04F 13/06 52/211
5,644,892 A * 7/1997 Smythe, Jr. ..... E04F 13/06 52/287.1
5,820,958 A * 10/1998 Swallow ..... E04F 13/04 52/514
6,145,259 A * 11/2000 Koenig, Jr. ..... E04F 13/06 52/287.1
6,607,621 B1 * 8/2003 Swanson ..... E04G 23/0203 29/402.09
7,316,835 B1 * 1/2008 Swanson ..... C09J 7/29 29/402.09
8,613,181 B2 * 12/2013 Jay ..... E06B 1/62 52/745.15
8,615,950 B1 * 12/2013 Gomes ..... E04F 13/04 52/255
9,016,017 B2 * 4/2015 Ryden ..... E04B 1/625 52/220.8
D739,039 S * 9/2015 Gomes ..... D25/138
9,885,184 B2 * 2/2018 Gomes ..... E04F 13/06
D861,916 S * 10/2019 Gomes ..... D25/61
11,136,768 B2 * 10/2021 Brown ..... E04F 19/0486
2002/0078644 A1 * 6/2002 Crane ..... E04F 13/06 52/287.1
2003/0177710 A1 * 9/2003 Gatherum ..... E04F 13/06 52/302.6
2005/0247011 A1 * 11/2005 Hansen ..... E04G 23/0207 52/749.1
2006/0191237 A1 * 8/2006 Hansen ..... E04F 13/04 52/746.1
2008/0263971 A1 * 10/2008 Maziarz ..... E04F 13/06 52/204.1
2010/0326002 A1 * 12/2010 Sawada ..... E04F 13/0898 52/578
2013/0189500 A1 * 7/2013 Adams ..... C09J 7/21 28/100
2015/0197950 A1 * 7/2015 Lewis ..... E04G 23/0207 52/514.5
2015/0345150 A1 * 12/2015 Sacks ..... E04F 13/047 52/670
2017/0037638 A1 * 2/2017 Gomes ..... E04F 13/06
2017/0335569 A1 * 11/2017 Kruger ..... E04F 13/047
2021/0246671 A1 * 8/2021 Brown ..... E04F 19/0486
2023/0279677 A1 * 9/2023 Lin ..... E04C 5/16 52/203
2023/0407641 A1 * 12/2023 Kerschbaum ..... E04F 13/042
2024/0151042 A1 * 5/2024 Gioia ..... E04F 13/042

FOREIGN PATENT DOCUMENTS

DE 19942882 A1 * 6/2001 ..... E04C 5/07
DE 20113846 U1 * 11/2001 ..... E04F 13/06
DE 202008009172 U1 * 9/2008 ..... E04F 13/04
EP 0837197 A2 * 4/1998 ..... E04F 13/068
WO WO-9500731 A1 * 1/1995 ..... E04F 13/06
WO WO-9704194 A1 * 2/1997 ..... E04F 13/06
WO WO-03024614 A1 * 3/2003 ..... B05C 21/005
WO WO-2022100809 A1 * 5/2022 ..... E04F 13/068

OTHER PUBLICATIONS

"How to Apply Joint Tape", by Lisa Dingman; https://www.hunker.com/13418473/how-to-apply-joint-tape/ (Year: 2020).*
Pretty Handy Girl, "How to Finish Drywall", Apr. 5, 2013; https://prettyhandygirl.com/how-to-finish-drywall-spackling-or-mudding-sheetrock-joints/#top (Year: 2013).*
International Search Report and Written Opinion received for PCT/EP2020/000194, mailed Aug. 2, 2021.

* cited by examiner

JOINT STRIP FOR REINFORCEMENT OF DRYWALL PANEL JOINTS

BACKGROUND

The invention relates a joint strip for reinforcement of drywall panel joints.

A considerable part of work and time involved in constructing drywalls is dedicated to the jointing of the drywall panels, e.g. gypsum panels. The amount of work and time, and the quality of the resulting drywall surface heavily depends on the reinforcement strip involved.

The purpose of the joint strip is to reinforce the hardened drywall panel joint material to offer crack-resistance of the finished drywall surface and to assure smoothness of the drywall joints for the connection of the drywall panel edges. Correct jointing is important to ensure stability, airtightness, sound insulation, resistance against air humidity of the joint drywall section.

In general, jointing of drywall panels involves to carry out the following steps:

- Joint filler (the term joint filler or joint filler material is used to describe a bedding compound intended for filling the joints with joint tape strips) is mixed to exhibit the preferred moisture content. A more hydrous mixture can help the reinforcement strip to adhere thereto.
- Joint filler is applied on joints uniformly, approx. 80 mm wide and 0.5 mm-1 mm thick. The fluid consistency and layer thickness of the joint filler counteracts rapid water removal from the joint filler. This contributes to a good adhesive bonding between joint filler and reinforcement strip through wet adhesion. The edges of the drywall panel that make up the joint can be square shaped, half-rounded tapered, bevelled or a combination of the latter. Especially, tapered, bevelled and half-rounded edge types help to reduce the "joint hump"—an elevation of the reinforcement strip with respect to the underlying panel surface—in the joint area.
- The joint strip is embedded in the joint filler. The purpose of the joint strip is to reinforce the joint that has been filled with joint filler. Types of joint strips include mesh tape, fibre-glass tape and paper joint tape. Different types of joint strips vary in the offered crack resistance. It is advantageous to press from the centre of the joint strip outwards with a drywall spatula or trowel, so that excess material of the joint filler is pressed out from beneath the joint strip. By doing so, the elevation of the joint strip with respect to the underlying panel surface is reduced to a minimum. It can be continued smoothing the edge area with the excess wet joint filler that has been pressed out from beneath the joint strip.
- One or more coats of joint filler can be applied for smoothing, depending on the required surface quality.

The problem of joint strips known from the state of the art is that they do not provide seamless jointing in areas, e.g., around window and door openings, of drywall construction where many drywall panel joints occur in a small area (e.g. in case of the construction of a shutter housing), resulting in a joint pattern with numerous joints. Applying joint strips in these areas can easily lead to unwanted overlapping sections of joint strips which results in joint humps. It is thus very difficult or even impossible to achieve a smooth finished drywall surface free of elevations due to the overlapping sections of the joint strips in these areas.

It is an object of the invention to provide a joint strip for reinforcement of drywall panel joints which overcomes or at least reduces the disadvantages known from the prior art and in particular to reduce the occurrence of joint humps.

SUMMARY

The invention relates to a joint strip for reinforcement of drywall panel joints comprising a strip portion with an inside corner comprising at least a first edge portion and a second edge portion arranged at an predetermined angle ($70° < \alpha < 110°$, i.e. $80° < \alpha < 100°$). The strip portion being shaped to extend from the first edge portion and the second edge portion (symmetrically and/or in the same manner to form a coherent surface). The inside corner can be arranged to cover adjoining edges of a corner of a window or door opening in a drywall construction. The strip portion is shaped to extend from the first edge portion and the second edge portion so as to allow for covering the joints arranged at the corner of a window and door opening of a drywall construction where many drywall panel joints occur in particular small areas.

According to a preferred aspect, the first edge portion and the second edge portion are arranged at a right angle of $\alpha = 90°$. Being arranged at a right angle the first edge portion and the second edge portion can be aligned at a corner of a window and door opening of a drywall construction.

According to another preferred aspect, the strip portion is shaped to extend vertically and horizontally from the inside corner in a range of from 40 mm to 150 mm. Thereby the strip portion is large enough to cover joints within an area along the bisecting line of a corner of a window and door opening of a drywall construction.

According to a particularly preferred aspect, the first edge portion and the second edge portion have differing lengths. That allows varying the length of the first edge portion and the second edge portion covering joints situated at different positions on each side from the corner a window and door opening of a drywall construction.

According to an advantageous aspect, the length ratio of the first edge portion and the second edge portion is at least 2:1. That difference in length allows for covering large areas on a single side from the corner of a window and door opening of a drywall construction.

According to another advantageous aspect, the inside corner comprises a third edge portion arranged with an angle $115° < \beta < 155°$ to the first edge portion and arranged between the first edge portion and the second edge portion. The third edge portion can be arranged very close to the corner of a window and door opening of a drywall construction without adding much thickness to the edges of the construction.

According to a particularly advantageous aspect, the third edge portion is arranged at $\beta = 135°$ to the first edge portion. The third edge portion can be arranged symmetrically between the first edge portion and the second edge portion.

According to a preferred aspect, the length of the third edge portion is such that the lateral distance of the first edge portion from the centre of the third edge portion is in the range between 3 cm and 4 cm.

According to another preferred aspect, the length of the third edge portion is at least 8 cm.

According to a particularly preferred aspect, the joint strip comprises an outside corner formed to correspond the inside corner, and the outside corner being arranged diametrically to the inside corner.

According to an advantageous aspect, the strip portion can be made of a natural fibre material (e. g. cellulose), a synthetic fibre material (e. g. PET, polyester, polypropylene or polyethylene), an inorganic fibre material (e. g. glass fibres or rock wool fibres) or combinations thereof, preferably a natural fibre material (e. g. cellulose) or a synthetic fibre material (e. g. PET, polyester, polypropylene or polyethylene), or combinations thereof.

The strip portion can be a mesh tape (preferably with a small mesh size, so that no joint filler material can go through), a fibre-glass tape, a paper joint tape or a synthetic fibre material tape or combinations thereof, preferably a paper joint tape or a synthetic fibre material tape or combinations thereof.

Further, independent protection is sought for a method for reinforcing panel joints i.e. around a corner of a window or door opening comprising the steps:

- applying a first layer of joint filler material at the joints formed by abutting panels; (thereafter)
- applying a joint strip (as described herein) with an inside corner at a corner formed by the window or door opening to cover the joints of the abutting panels; (thereafter)
- applying at least one further layer of joint filler material at the joint strip.

According to a preferred aspect, the step of applying the joint strip comprises to arrange the joint strip with a strip portion in a direction corresponding to the bisecting line of the corner of the window or door opening.

According to another preferred aspect, only one joint strip is arranged in one corner surface of the window or door opening.

According to a particularly preferred aspect, the joint strip is arranged with a third edge portion to form a tangent line at the corner of the window or door opening.

BRIEF DESCRIPTION OF THE DRAWINGS

In the following, the invention is illustrated in more detail by means of the examples shown in the attached drawings, in which.

DETAILED DESCRIPTION

Figure 1:
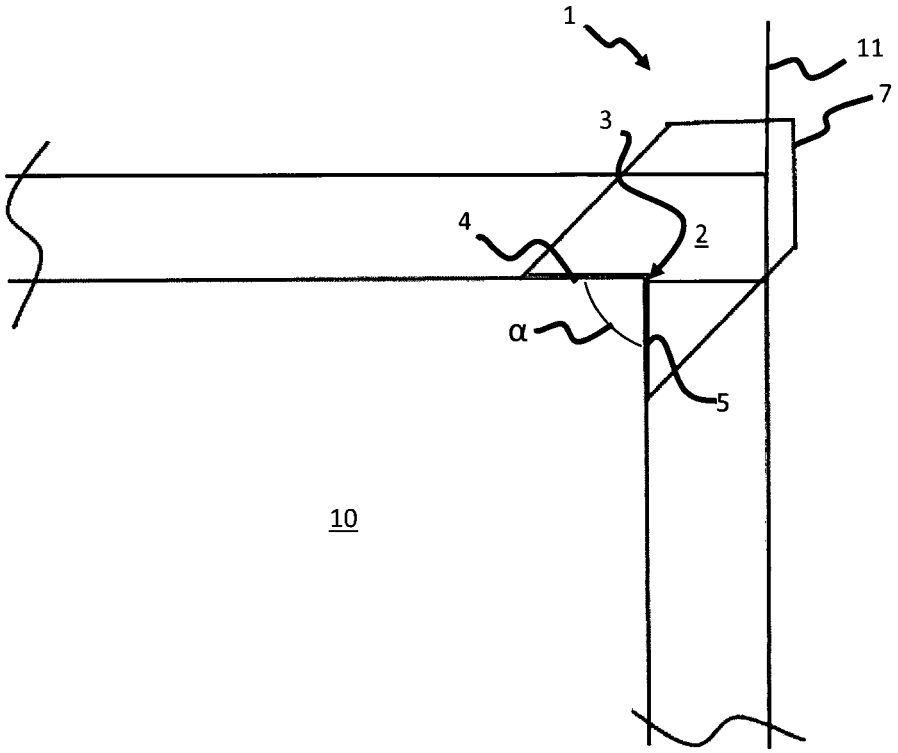
FIG. 1 is an illustration of a window or door opening with a first variant of the joint strip according to the invention.

In FIG. 1 the joint strip 1 is shown when arranged at an exemplified window or door opening 10 in a drywall construction for reinforcement of drywall panel joints 11.

The joint strip 1 has a strip portion 2 with an inside corner 3 formed by a first edge portion 4 adjoining a second edge portion 5. In the shown example, the first edge portion 4 and the second edge portion 5 are arranged at an right angle of $\alpha=90°$ which corresponds to the angle of the window or door opening 10 in the drywall construction.

Due to that the inside corner 3 can be arranged to cover adjoining edges of a corner of a window or door opening 10 in a drywall construction, the occurrence of joint humps can be prevented. The shape of the strip portion 2 of the joint strip 1, which extends from the first edge portion 4 and the second edge portion 5 allows that multiple joint strips are not needed so that unwanted overlapping sections are prevented. A smooth finished drywall surface free of elevations due to the overlapping sections of the joint strips in these areas is achieved.

The strip portion 2 is shaped to extend from the first edge portion 4 and the second edge portion 5 to allow for covering the joints 11 arranged at the corner of a window and door opening 10 of a drywall construction where many drywall panel joints 11 occur in particular small areas.

Advantageously, the strip portion 2 is shaped to extend vertically and horizontally from the inside corner 3 in a range of from 40 mm to 150 mm. That range allows to cover joints 11 which typically occur in the vicinity at the corner of a window and door opening of a drywall construction, e.g. a shutter housing.

Not limited to the illustrated example, the joint strip 1 comprises an outside corner 7 formed to correspond the inside corner 3. The outside corner 7 is arranged diametrically to the inside corner 3.

The strip portion 2 is made of a natural fibre material, an inorganic fibre material or a synthetic fibre material of combinations thereof.

The joint strip 1 is applied in the same manner for all variants of the invention by a method for reinforcing panel joints 11 around a corner of a window or door opening 10 comprising the steps:

- applying a first layer of joint filler material (not shown) at the joints 11 formed by abutting panels;
- applying a joint strip 1 with an inside corner 3 at a corner formed by the window or door opening 10 to cover the joints 11 of the abutting panels;
- applying at least one further layer of joint filler material (not shown) at the joint strip 1.

The step of applying the joint strip 1 comprises to arrange the joint strip 1 with a strip portion 2 in a direction corresponding to the bisecting line of the corner of the window or door opening 10.

Advantageously, only one joint strip 1 is arranged in one corner of the window or door opening 10.

Figure 2:
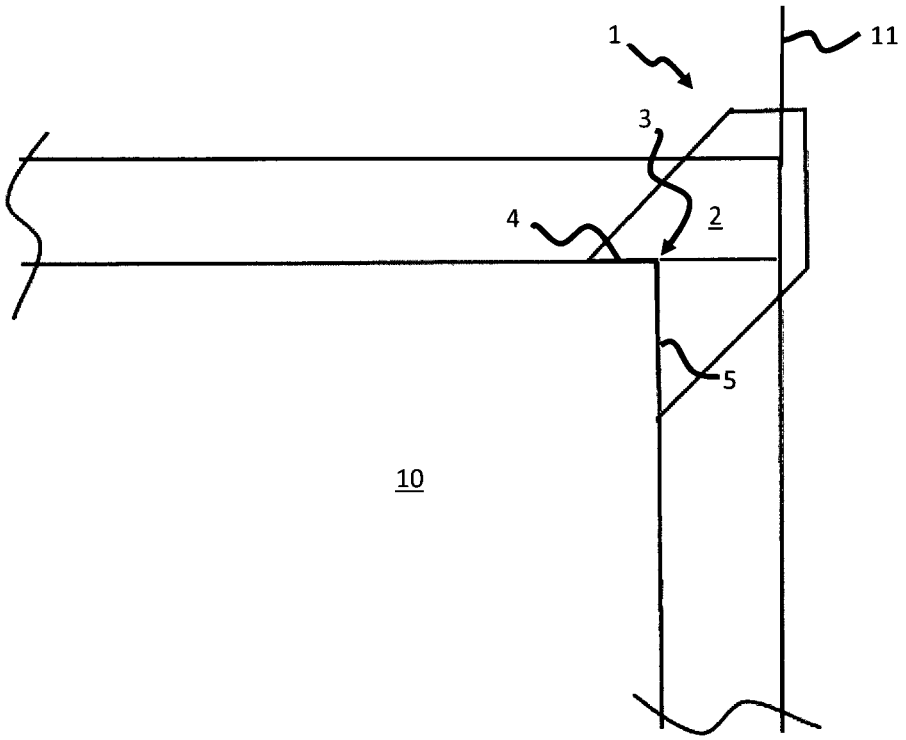
FIG. 2 is an illustration of a window or door opening with a second variant of the joint strip according to the invention.

A second variant of the joint strip 1 according to the invention is shown in FIG. 2 wherein the first edge portion 4 and the second edge portion 5 have differing lengths. As can be seen in the drawing, the differing length allows to covering the joints 11 at one (right) side of the corner of a window and door opening 10 in a larger area compared to the other (left) side.

The length ratio of the first edge portion 4 and the second edge portion 5 is preferably at least 2:1.

Figure 3:
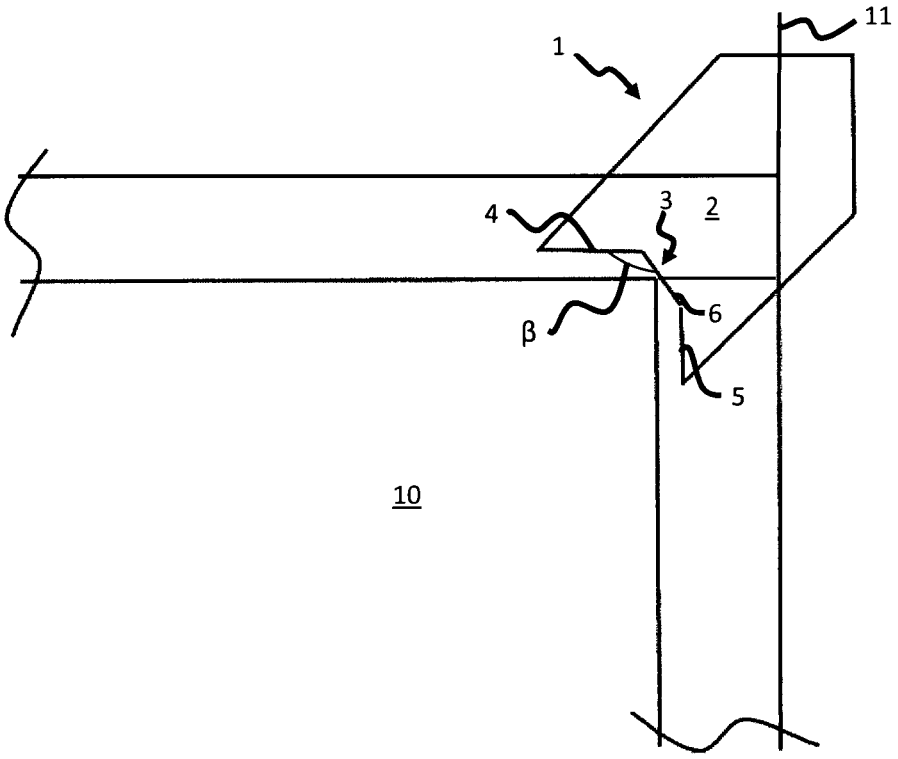
FIG. 3 is an illustration of a window or door opening with a second variant of the joint strip according to the invention.

A third variant of the joint strip 1 according to the invention is shown in FIG. 3 wherein the inside corner 3 has a third edge portion 6 arranged between the first edge portion 4 and the second edge portion 5. Advantageously, the joint strip 1 is arranged with a third edge portion 6 to form a tangent line at the corner of the window or door opening 10. The third edge portion 6 can advantageously be arranged at the tip of the corner of a window and door opening 10 while the first edge portion 4 and the second edge portion are at a distance to the corner which allows to apply the filler material directly to the panel surface at the edges which form the corner of a window and door opening 10.

The joint strip 1 comprises a third edge portion 6 which can be arranged generally with an angle $115°<\beta<155°$ to the first edge 4 portion. In the shown example, the third edge portion 6 is arranged at $\beta=135°$ to the first edge portion 4.

In this preferred example, the length of the third edge portion 6 is such that the lateral distance d of the first edge portion 3 from the centre of the third edge portion 6 is between 3 cm and 4 cm. The length of the third edge portion 6 is preferably at least 8 cm.

While a particular embodiment of the present joint strip for reinforcement of drywall panel joints has been described herein, it will be appreciated by those skilled in the art that changes and modifications may be made thereto without departing from the invention in its broader aspects and as set forth in the following claims.

The invention claimed is:

1. A drywall panel joint, comprising:

a vertical drywall panel and a horizontal drywall panel which together form a corner joint of an opening defining a vertical segment and a horizontal segment; and a strip portion which is applied to the corner joint by a layer of joint filler material, such that an inside corner of the strip portion comprises at least a first edge portion which is parallel to the vertical segment of the opening and a second edge portion which is parallel to the horizontal segment of the opening and is arranged at an angle relative to the first edge portion; the strip portion being shaped to extend from the first edge portion and the second edge portion, and the strip portion being a paper joint tape or a synthetic fiber material tape, wherein the first edge portion is displaced from the vertical segment and the second edge portion is displaced from the horizontal segment.

2. The drywall panel joint according to claim 1, wherein the first edge portion and the second edge portion are arranged at a right angle.

3. The drywall panel joint according to claim 1, wherein the strip portion is shaped to extend from the inside corner in a range of from 40 mm to 150 mm.

4. The drywall panel joint according to claim 1, wherein the first edge portion and the second edge portion have differing lengths.

5. The drywall panel joint according to claim 4, wherein the length ratio of the first edge portion and the second edge portion is at least 2:1.

6. The drywall panel joint according to claim 1, wherein the inside corner comprises a third edge portion arranged with an angle $115° < \beta < 155°$ to the first edge portion and arranged between the first edge portion and the second edge portion.

7. The drywall panel joint according to claim 6, wherein the third edge portion is arranged at $\beta = 135°$ to the first edge portion.

8. The drywall panel joint according to claim 7, wherein the length of the third edge portion is such that a lateral distance of the first edge portion from the center of the third edge portion is between 3 cm and 4 cm.

9. The drywall panel joint according to claim 6, wherein the length of the third edge portion is at least 8 cm.

10. The drywall panel joint according to claim 1, comprising an outside corner formed to correspond to the inside corner, and the outside corner being arranged diametrically to the inside corner.

11. The drywall panel joint according to claim 1, wherein the outside corner extends beyond the vertical drywall panel and the horizontal drywall panel.

12. A method for a reinforcing panel joint around a corner joint of an opening formed by a vertical drywall panel and a horizontal drywall panel and defining a vertical segment and a horizontal segment comprising the steps:

applying a first layer of joint filler material at the corner joint;

applying a joint strip to the corner joint via the first layer of joint filler material, such that the an inside corner of the joint strip comprises at least a first edge portion which is parallel to the vertical segment of the opening and a second edge portion which is parallel to the horizontal segment of the opening arranged at an angle relative to the first edge portion, the strip portion being shaped to extend from the first edge portion and the second edge portion, and the strip portion being a paper joint tape or a synthetic fiber material tape, wherein the first edge portion is displaced from the vertical segment and the second edge portion is displaced from the horizontal segment; and applying at least one further layer of joint filler material at the joint strip.

13. The method according to claim 12, wherein the step of applying the joint strip comprises to arrange the joint strip with a strip portion in a direction corresponding to the bisecting line of the corner of the window or door opening.

14. The method according to claim 12, wherein only one joint strip is arranged in one corner of the window or door opening.

15. The method according to claim 12, wherein the joint strip is arranged with a third edge portion to form a tangent line at the corner of the window or door opening.

* * * * *